US007351901B2

(12) United States Patent
Hsieh

(10) Patent No.: US 7,351,901 B2
(45) Date of Patent: Apr. 1, 2008

(54) BEARING DEVICE FOR A PEDAL ASSEMBLY

(75) Inventor: Wu-Hong Hsieh, Lu Chou (TW)

(73) Assignee: K.H.S. Musical Instrument Co., Ltd., Taipei Hsien (TW)

( * ) Notice: Subject to any disclaimer, the term of this patent is extended or adjusted under 35 U.S.C. 154(b) by 0 days.

(21) Appl. No.: 11/415,153

(22) Filed: May 2, 2006

(65) Prior Publication Data

US 2007/0297860 A1 Dec. 27, 2007

(51) Int. Cl.
*G10D 13/02* (2006.01)

(52) U.S. Cl. ..... 84/422.1; 84/422.2; 84/422.3

(58) Field of Classification Search ..... None
See application file for complete search history.

(56) References Cited

U.S. PATENT DOCUMENTS 4,890,532 A * 1/1990 Carlson ..... 84/422.1
6,137,040 A * 10/2000 Hoshino ..... 84/422.1
6,155,133 A * 12/2000 Swansegar et al. ..... 74/513
6,281,418 B1 * 8/2001 Chang ..... 84/422.1
6,725,741 B2 * 4/2004 Menzies ..... 74/514
6,745,643 B2 * 6/2004 Lubanski ..... 74/594.6

* cited by examiner

*Primary Examiner*—Tara L. Mayo
(74) *Attorney, Agent, or Firm*—Rabin & Berdo, P.C.

(57) ABSTRACT

A bearing device for a pedal assembly includes an integrally formed positioning block, a connecting block and a bearing. The connecting block has a connecting hole aligning with a second threaded hole of the positioning block, a second cutout defined in a top side of the connecting block to communicate with a first cutout of the positioning block and an engagement hole defined in a lower portion thereof for engagement with a recoil spring of the pedal assembly. A bearing is securely received in the first cutout and the second cutout. A first threaded bolt is extending through the aligned first threaded hole and the through hole for secure engagement of the bearing inside the positioning block. A second threaded bolt is extending into the aligned connecting hole and the second threaded hole to secure engagement between the positioning block and the connecting block.

5 Claims, 5 Drawing Sheets

BEARING DEVICE FOR A PEDAL ASSEMBLY

BACKGROUND OF THE INVENTION

1. Field of the Invention

The present invention relates to a bearing device, and more particularly to bearing device for a pedal assembly to provide smooth pivotal movement to the pedal assembly so that the stability of the pedal assembly will not be influenced during operation of the pedal assembly.

2. Description of the Prior Art

A pedal assembly is connected to a drum set to control operation of a drumstick such that when the pedal assembly is operated by the drummer, the drumstick is able to hit the drum surface. With reference to FIG. 5, the conventional pedal assembly is shown and includes a chain (51) connected to a distal end of a pedal (not numbered), a driving rod (52) connected to a free end of the chain (51), a positioning block (53) mounted on an end of the driving rod (52), a bearing (54) mounted outside the positioning block (53) and securely connected to the positioning block (53) and a recoil spring (55) one end of which is provided with a hook (551) received in a circular recess (541) which is defined in an outer periphery of the bearing (54) and the other end of which is securely connected to a base (not numbered) of the pedal assembly. When the pedal is operated by the drummer, the driving rod (52) is driven by the chain (51) to pivot. The pivotal movement of the driving rod (52) thus drives the positioning block (53) to pivot as well. Again, the bearing (54) being securely mounted on the positioning block (53) is also pivoted along with the positioning block (53). Due to the hook (551) being received in the circular recess (541) of the bearing (54), the pivotal movement of the bearing (54) drives the recoil spring (55) to move as a result of friction between the bearing (54) and the hook (551). It is noted that when the recoil spring (55) is moved, the stability of the pedal assembly reduces, which seriously affects the performance of the drummer. In order to increase the stability of the pedal assembly without affecting the normal performance of the drummer, new structure is introduced to the market, wherein the bearing is substantially received in the positioning block which is securely connected to a connecting block. The connecting block is later connected to the recoil spring. The structure does improve the stability of the pedal assembly. However, a closer look at the improved pedal assembly shows that the positioning block has a slit defined therein and a securing bolt laterally extending through the positioning block to secure opposite sides defining the slit so that the bearing is able to be securely received in the positioning block.

It is well known in the art that when the pedal assembly is in operation, the stress on the positioning block may break the positioning block and thus the pedal assembly suffers an irreversible damage once the positioning block breaks.

To overcome the shortcomings, the present invention tends to provide an improved pedal assembly to mitigate the aforementioned problems.

SUMMARY OF THE INVENTION

The primary objective of the present invention is to provide an improved bearing device having a positioning block, a connecting block securely engaged with the positioning block and a bearing sandwiched between the positioning block and the connecting block. The positioning block is integrally formed into one piece and has a first threaded hole and a second threaded hole. The connecting block has a connecting hole defined to correspond to and align with the second threaded hole of the positioning block such that after alignment among the first threaded hole, a through hole defined in the bearing and the connecting hole of the connecting block is finished, a first threaded bolt extending into the aligned first threaded hole, the through hole of the bearing and the connecting hole of the connecting block ensures the bearing is securely received between the positioning block and the connecting block.

Another objective of the present invention is that the positioning block has a first cutout defined in a side face of the positioning block and the connecting block has a second cutout defined in a top side thereof so that after combination between the positioning block and the connecting block, the bearing is securely received in the first cutout and the second cutout.

Still another objective of the present invention is that the connecting block has an annular stop formed on a periphery defining the second cutout to prevent the bearing from moving away from the positioning block and the connecting block.

Other objects, advantages and novel features of the invention will become more apparent from the following detailed description when taken in conjunction with the accompanying drawings.

DETAILED DESCRIPTION OF THE PREFERRED EMBODIMENT

Figure 1:
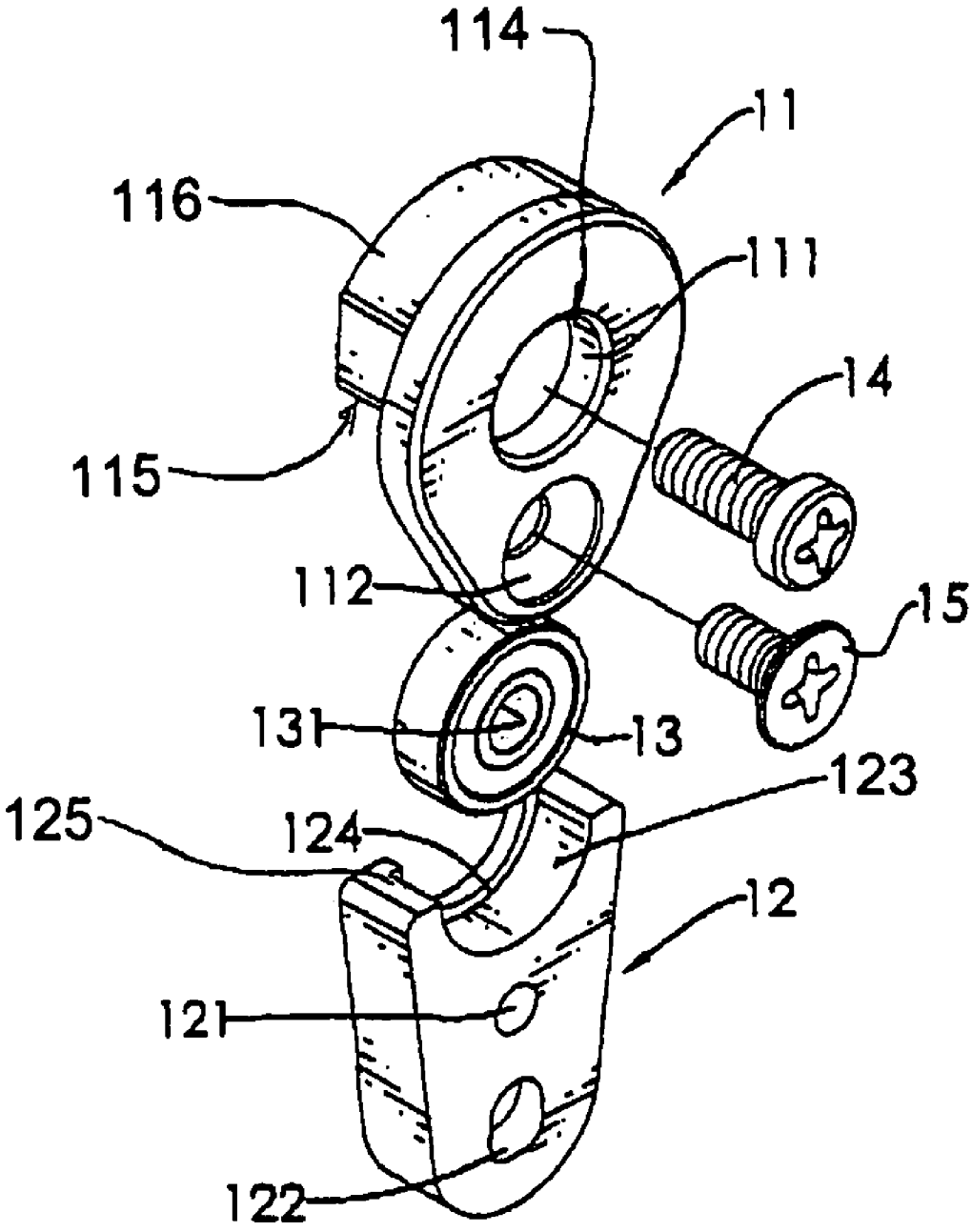
FIG. 1 is an exploded perspective view of the bearing device of the present invention.
Figure 2:
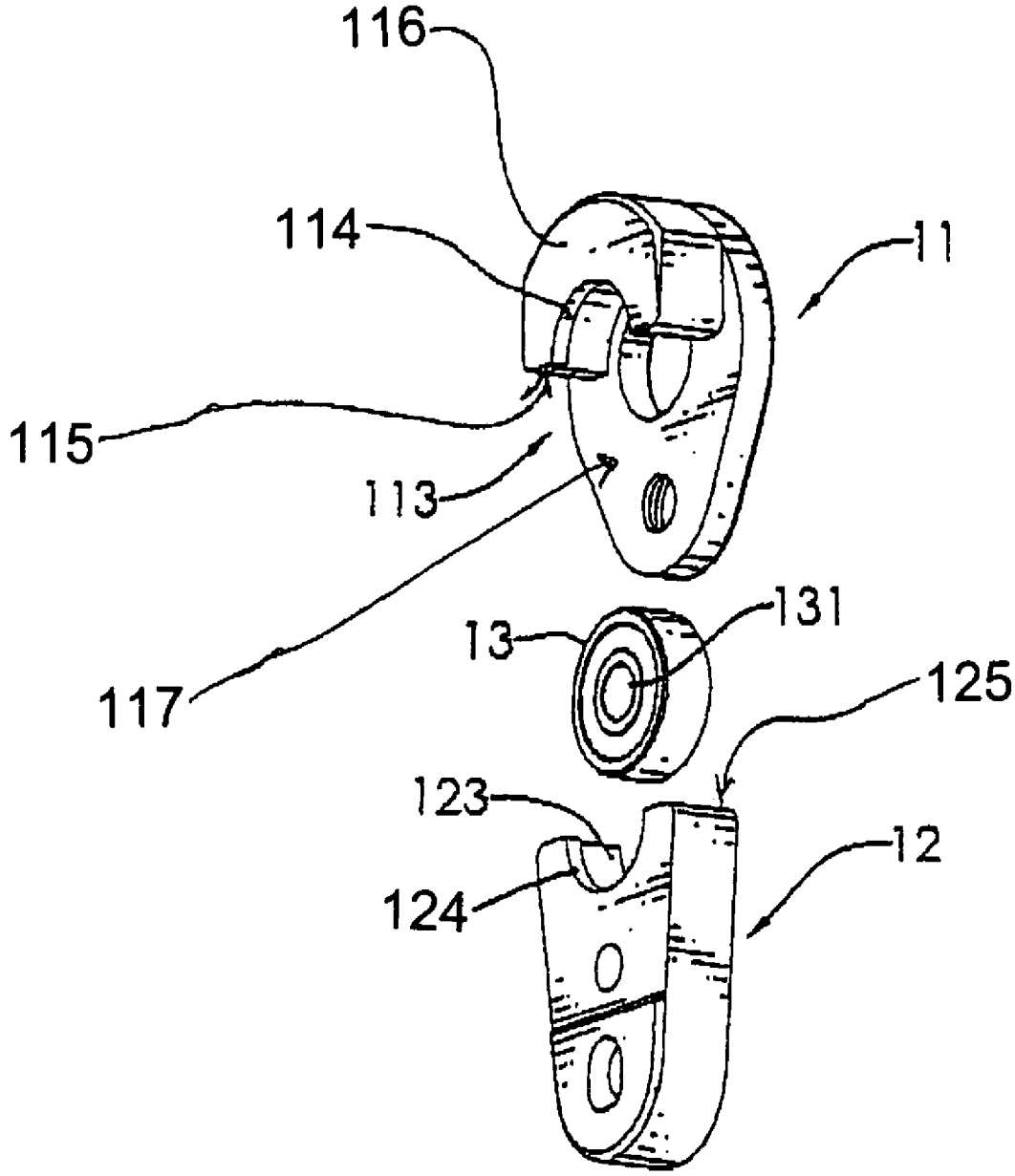
FIG. 2 is an exploded perspective view of the bearing device from an angle different from that of FIG. 1.

With reference to FIGS. 1 and 2, it is noted that the bearing device in accordance with the present invention includes a positioning block (11), a connecting block (12) and a bearing (13).

The positioning block (11) has a side face (117), a first threaded hole (111), a second threaded hole (112), a first cutout (113), and a protruding portion (116). The protruding portion (116) is formed on and protrudes from the side face (117) of the positioning block (11) and it has a transverse bottom surface (115). The first cutout (113) is defined in the transverse bottom surface (115) of the protruding portion (116) of the positioning block (11), it communicates with the first hole (111), and it has a first outer cutout edge including a first annular stop 114.

The connecting block (12) has a connecting hole (121), an engagement hole (122), a second cutout (123), a second annular stop (124), and a transverse top surface (125). The connecting hole (121) is defined through the connecting block (12) to align with the second threaded hole (112) of the positioning block (11). The engagement hole (122) is defined in lower portion of the connecting block (12). The second cutout (123) is defined in the transverse top surface (125) of the connecting block (12) to correspond to the first cutout (113) of the positioning block (11) and has a second outer cutout edge. The second annular stop (124) is formed on the outer cutout edge of the second cutout (123). The transverse top surface (125) abuts the transverse bottom surface (115) of the protruding portion (116) to keep the connecting block (12) from rotating relative to the positioning block (11). The first annular stop (114) and the second annular stop (124) abut to form an annulus, as shown in FIG. 3B.

The bearing (13) has a through hole (131) defined to align with the first threaded hole (111) of the positioning block (11).

Figure 3A:
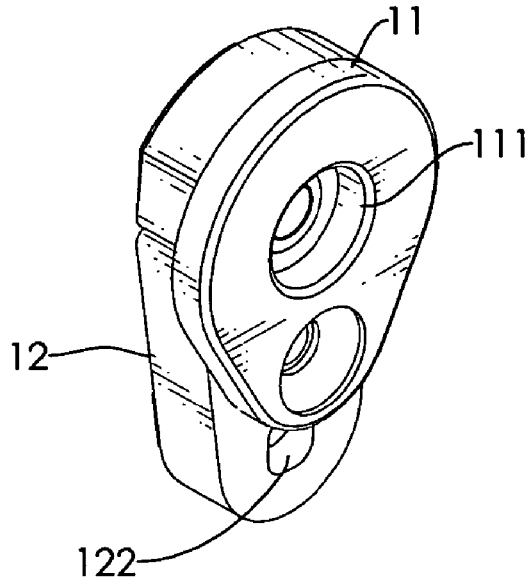
FIGS. 3A and 3B are perspective views showing that the bearing device of the present invention is assembled with the bearing securely received between the positioning block and the connecting block.
Figure 3B:
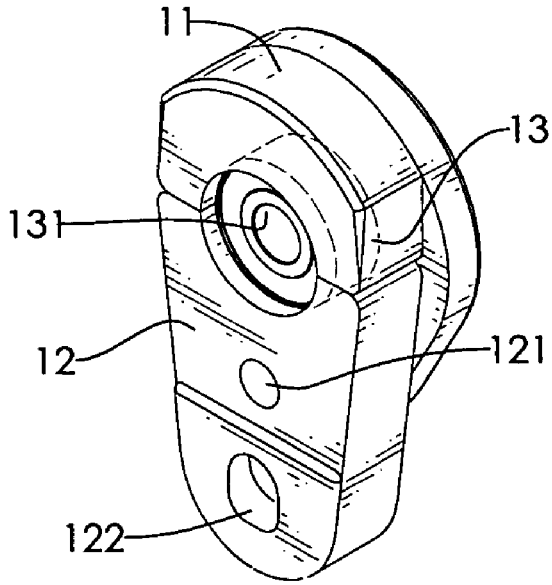
Figure 4:
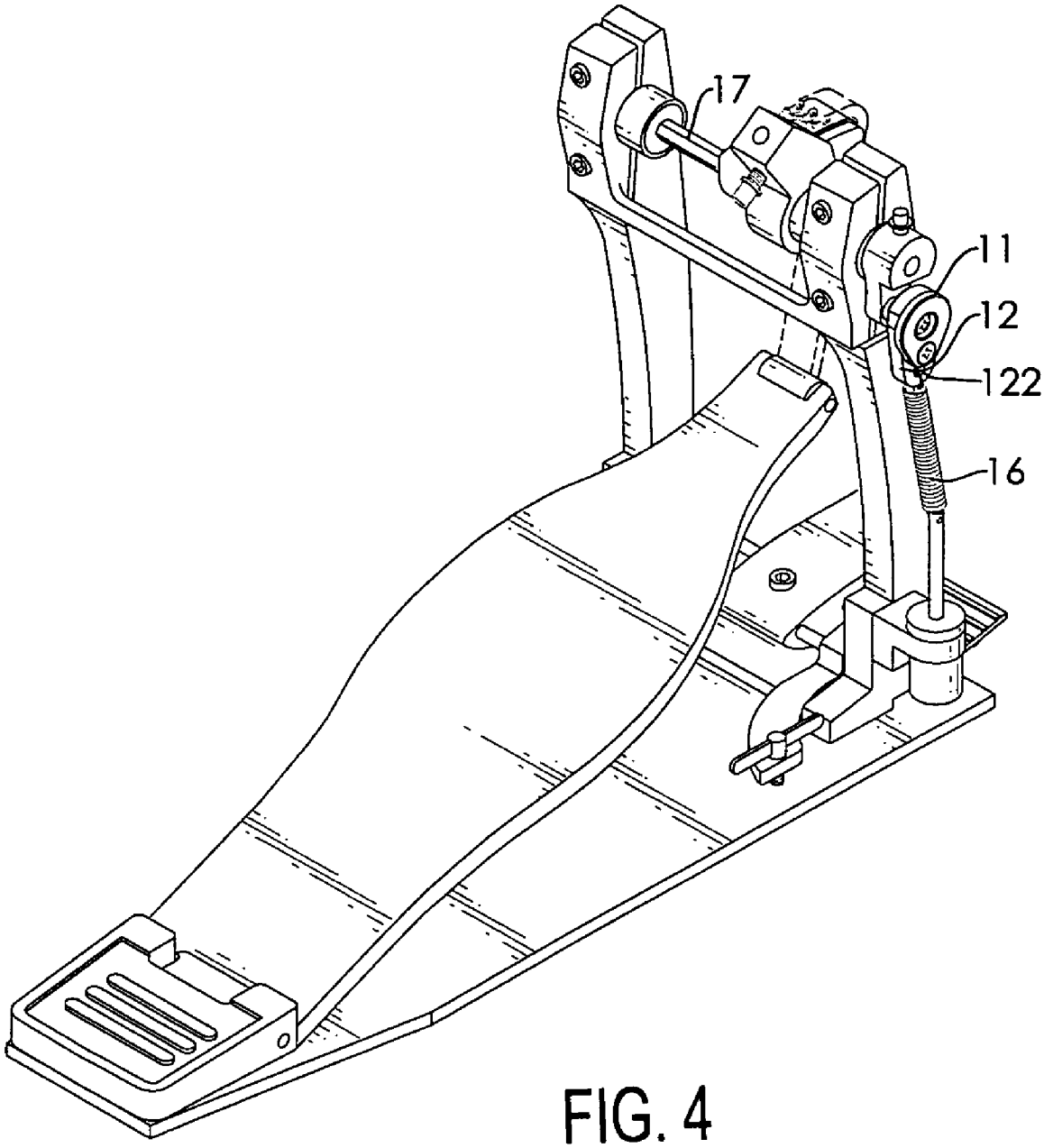
FIG. 4 is a perspective view showing the assembly of the bearing device of the present invention.
Figure 5:
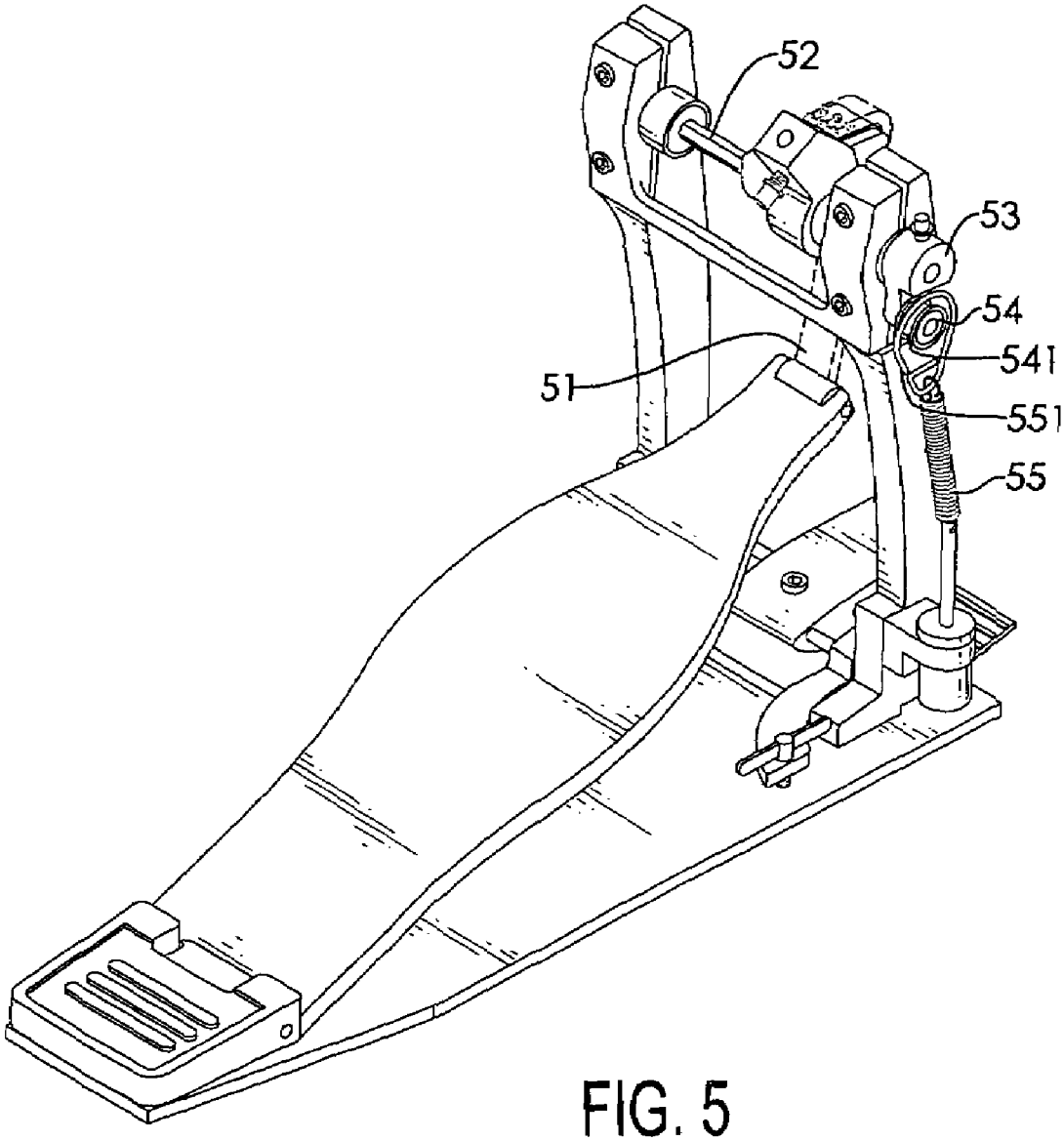
FIG. 5 PRIOR ART
FIG. 5 is a perspective view showing the structure of a conventional pedal assembly.

When the bearing device of the present invention is assembled, as shown in FIG. 4, with reference to FIGS. 3A and 3B and referring to FIG. 1 for reference, the through hole (131) of the bearing (13) is aligned with the first threaded hole (111) of the positioning block (11) and a first threaded bolt (14) is extended through the aligned first threaded hole (111) and the through hole (131) to securely connect the combination of the positioning block (11) and the bearing (13) to a driving rod (17) of the pedal assembly (not shown). Then a second threaded bolt (15) is extended through the second threaded hole (112) of the positioning block (11) and the connecting hole (121) of the connecting block (12) to secure engagement between the positioning block (11) and the connecting block (12). Thereafter, the bearing (13) is securely received between the first cutout (113) and the second cutout (123). The annular stop (124) engages with a peripheral edge of the bearing (13) to prevent the bearing (13) from moving away from the combination of the positioning block (11) and the connecting block (12). A recoil spring (16) from the pedal assembly is able to engage with a periphery defining the engagement hole (122) of the connecting block (12) such that when the pedal assembly is in operation, only the positioning block (11) pivots along with the driving rod, but not the connecting block (12), which secures the stability of the pedal assembly.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A bearing device for a pedal assembly to stabilize movement of a recoil spring in the pedal assembly, the bearing device comprising:

(a) a positioning block including a side face, a first hole, a second hole, a protruding portion formed on and protruding from the side face of the positioning block and having a transverse bottom surface, and a first bearing cutout defined in the transverse bottom surface of the protruding portion of the positioning block, the first hole communicating with the first bearing cutout;

(b) a connecting block including a transverse top surface, a lower portion, a connecting hole defined to align with the second hole of the positioning block, a second bearing cutout defined in the transvere top surface of the connecting block to communicate with the first bearing cutout of the positioning block, an engagement hole defined in the lower portion for engagement with the recoil spring of the pedal assembly, the transverse top surface abutting the transverse bottom surface of the protruding portion to keep the connecting block from rotating relative to the positioning block;

(c) a bearing securely mounted in the first cutout and the second cutout and having a through hole aligned with the first hole of the positioning block;

(d) a first threaded bolt extending through the aligned first hole and the through hole for secure engagement of the bearing inside the positioning block; and (e) a second threaded bolt extending into the aligned connecting hole and the second hole of the positioning block to secure engagement between the positioning block and the connecting block.

2. The bearing device as claimed in claim 1, wherein the connecting block includes a second annular stop formed on an outer cutout edge defining the second bearing cutout to engage a peripheral edge of the bearing to prevent the bearing from moving away from the positioning block and the connecting block.

3. The bearing device as claimed in claim 2, wherein the positioning block includes a first annular stop formed on an outer cutout edge defining the first bearing cutout to engage a peripheral edge of the bearing to prevent the bearing from moving away from the positioning block and the connecting block.

4. The bearing device as claimed in claim 1, wherein at least one of the connecting hole and the second hole is threaded to mate with the second threaded bolt, to secure the engagement between the connecting block and the positioning block at the side face of the positioning block.

5. The bearing device as claimed in claim 1, wherein the first hole is threaded.

* * * * *